US007739986B2

(12) United States Patent
Seethaler et al.

(10) Patent No.: US 7,739,986 B2
(45) **Date of Patent: *Jun. 22, 2010**

(54) DEVICE FOR CONTROLLING THE LIFT OF A GAS EXCHANGE VALVE IN AN INTERNAL COMBUSTION ENGINE

(75) Inventors: Rudolf Seethaler, Munich (DE); Christian Beierlieb, Freising (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 253 days.

This patent is subject to a terminal disclaimer.

(21) Appl. No.: 11/798,307

(22) Filed: May 11, 2007

(65) Prior Publication Data

US 2007/0215083 A1 Sep. 20, 2007

Related U.S. Application Data

(63) Continuation of application No. PCT/EP2005/011220, filed on Oct. 19, 2005.

(30) Foreign Application Priority Data

Nov. 12, 2004 (DE) ..... 10 2004 054 773

(51) Int. Cl.
*F01L 1/34* (2006.01)

(52) U.S. Cl. ..... 123/90.16; 123/90.11; 251/129.01

(58) Field of Classification Search ..... 123/90.15, 123/90.16, 90.17, 90.18, 90.11, 90.27, 90.31; 73/1.79; 251/129.01

See application file for complete search history.

(56) References Cited

U.S. PATENT DOCUMENTS 5,765,513 A 6/1998 Diehl et al.
7,055,475 B2 6/2006 Denteler et al.
7,111,598 B2 9/2006 Gaubatz et al.
2006/0278190 A1 12/2006 Meyer

FOREIGN PATENT DOCUMENTS

DE 199 47 758 A1 4/2001

(Continued)

OTHER PUBLICATIONS

International Search Report dated Feb. 22, 2006 including English translation (Four (4) pages).

(Continued)

*Primary Examiner*—Ching Chang
(74) *Attorney, Agent, or Firm*—Crowell & Moring LLP

(57) ABSTRACT

A device and a method are provided for regulating the lift characteristic of a charge cycle valve of an internal combustion engine. The device comprises a controllable drive unit having an actuator element for actuating the charge cycle valve, two energy storage means acting on the charge cycle valve in opposite drive directions and a regulating means for controlling the drive unit. The regulating unit controls the drive unit according to a stored setpoint path, on the basis of which the charge cycle valve is transferred from a first end position into a second end position and vice versa. The setpoint path is designed so that it maps the ideal transient characteristic of the energy storage-drive element-energy storage system of the device without taking any additional ambient influences into account.

10 Claims, 2 Drawing Sheets

FOREIGN PATENT DOCUMENTS

| | | | |
|---|---|---|---|
| DE | 100 34 877 | C1 | 10/2001 |
| DE | 101 40 461 | A1 | 2/2003 |
| DE | 102 52 991 | A1 | 5/2004 |
| DE | 103 18 245 | A1 | 11/2004 |
| DE | 103 58 936 | A1 | 7/2005 |

OTHER PUBLICATIONS

German Search Report dated Aug. 4, 2005 including English translation (Six (6) pages).

DEVICE FOR CONTROLLING THE LIFT OF A GAS EXCHANGE VALVE IN AN INTERNAL COMBUSTION ENGINE

This application is a Continuation of PCT/EP2005/011220, filed Oct. 19, 2005, and claims the priority of DE 10 2004 054 773.4, filed Nov. 12, 2004, the disclosures of which are expressly incorporated by reference herein.

BACKGROUND AND SUMMARY OF THE INVENTION

The present invention relates to a device and a method for regulating the lift characteristic of a charge cycle valve of an internal combustion engine.

In traditional combustion engines, the camshaft is driven mechanically by the crankshaft via a control chain or a control belt. To increase engine power and reduce fuel consumption, it is very advantageous to control the valves of the individual cylinders individually. This is possible through a so-called fully variable valve drive (variable control times and variable valve lift), e.g., a so-called electromagnetic valve drive. With a fully variable valve drive, an "actuator unit" is allocated to each valve and/or each "valve group" of a cylinder. At the present point in time, different basic types of actuator units are being researched.

With one basic type (so-called lift actuators), an opening magnet and a closing magnet are allocated to a valve or a valve group. The valves may be displaced axially, i.e., opened and/or closed, by supplying the magnets with electric power.

With another basic type (so-called rotary actuator) a control shaft is provided with a cam, whereby the control shaft is pivotable back and forth by an electric motor.

German Patent Document DE 101 40 461 A1 describes a rotary actuator device for controlling the lift of a charge cycle valve. The lift is controlled here by an electric motor, which is itself controlled by an engine characteristics map, a shaft with a control cam connected to it in a rotationally fixed manner being arranged on the rotor of said electric motor. During operation of the internal combustion engine, the motor pivots, i.e., swings back and forth, and the control cam periodically forces the charge cycle valve into its open position via a roller-lever actuator. The charge cycle valve is closed by the spring force of a valve spring. In order for the electric motor not to have to overcome the total spring force of the valve spring in opening the charge cycle valve, an additional spring is mounted on the shaft. The forces of the valve spring and additional spring are such that in periodic operation of the rotational actuator device according to the position of the charge cycle valve, the kinetic energy is either stored in the valve spring or in the additional spring. As a result of this measure, the power consumption during operation of the rotary actuator device is reduced. One disadvantage of the rotary actuator device described here is the high power consumption at low rotational speeds.

German Patent Document DE 102 52 991 A1 describes a further embodiment of such a rotary actuator device. The existing rotary actuator device is expanded here by a second actuator element (second control cam) in the opposite direction of rotation and with a smaller lift than that of the main cam. This second actuator element does not open the valve completely and is used only for small lifts in the range of low engine rotational speeds. At low rotational speeds of the internal combustion engine, the rotary actuator device receives electric power, so that the shaft pivots only in the direction of the second actuator element, whereas at high rotational speeds, the motor is swiveled only in the direction of the first actuator element. Due to the small lift, the rotary actuator device advantageously consumes less electric current at a low rotational speed.

The object of the present invention is to create a device for regulating the lift characteristic of a charge cycle valve that ensures an improvement with regard to electric power consumption by an actuator device.

According to this invention, this object is achieved by the totality of features of the independent claims.

The inventive device for regulating the lift characteristic of a charge cycle valve comprises a regulating device (so-called setpoint path regulator) which controls a drive unit (e.g., the electric motor of a rotary actuator or the electromagnet(s) of an electromagnetic lift actuator or the drive mechanism of a slewing actuator) according to a stored setpoint path, whereby the setpoint path is such that it maps the ideal transient characteristic of the energy storage-drive element-energy storage system (spring-mass-spring system) of the actuator device (plus the valve unit to be driven with the charge cycle valve and the closing spring). Stored setpoint path(s) in the sense of this invention include setpoint paths (data) stored once in a memory as well as stored calculation procedures on the basis of which such a setpoint path can be calculated online. This device is to be used to advantage in a rotary actuator device according to German Patent Document DE 101 40 461 A1, where it should reduce the power consumption of the electric motor used here by regulating the rotational characteristic of the rotor of the drive motor according to the ideal setpoint path of the oscillating system of the rotary actuator device as determined here. On the basis of this regulation, a regulating behavior is then established, in which the electric motor smoothes out ambient influence such as friction and gas backpressure that deviate from the ideal (calculated) oscillating system by supplying additional driving power.

An ideal transient characteristic in the sense of this invention is characterized in that the oscillating behavior is free of friction losses and ambient influences such as gas pressures and gas backpressures. Ideally, an ideal oscillating behavior corresponds to the calculated oscillating characteristic of the system, free of any type of losses. The present invention advantageously relates to a spring-mass-spring system (according to German Patent Document DE 101 40 461 A1) having a valve restoring spring and/or opening spring (spring 1), an opening spring (spring 2) that counteracts the valve restoring spring and the mass moving between the springs in this system (e.g., rocker lever, drive cam plus driveshaft and rotor of the driven electric motor, mass components of the opening spring acting on the drive cam in the opening direction as well as the charge cycle valve plus amounts by weight of the moving closing spring).

In a particularly preferred refinement of the present invention, the device includes a rotary actuator device according to German Patent Document DE 103 58 936 which was not published previously. DE 103 58 936 is herewith incorporated with its full content in the disclosure of the present patent application in particular with regard to the design of a rotary actuator (but here in particular with regard to the arrangement and design of the opening spring as a rotary rod spring).

In another refinement of this invention, the rotary actuator is designed according to German Patent Document DE 102 52 991 A1 with an actuating element in the form of a so-called double cam driven by an electric motor. With regard to the special embodiment of a double cam having two such control paths, the content of German Patent Document DE 102 52 991 A1 is herewith also incorporated in the disclosure content of the present patent application.

To further reduce the energy demand by a rotary actuator, a plurality of so-called ideal setpoint paths are stored, each setpoint path describing a different valve lift. In one embodiment, at least one setpoint path with a maximum lift and one setpoint path with a reduced lift by comparison are stored as fixed setpoint paths (stored trajectory or corresponding calculation procedure). In a refinement, any curve characteristics required between these at least two fixed setpoint paths are formed by interpolation between the stored setpoint paths. Further refinements of the present invention relate to the design of the actuator device as a rotary actuator according to German Patent Document DE 101 40 461 A1 and according to German Patent Document DE 103 58 936.

Other objects, advantages and novel features of the present invention will become apparent from the following detailed description of the invention when considered in conjunction with the accompanying drawings.

DETAILED DESCRIPTION

Figure 1:
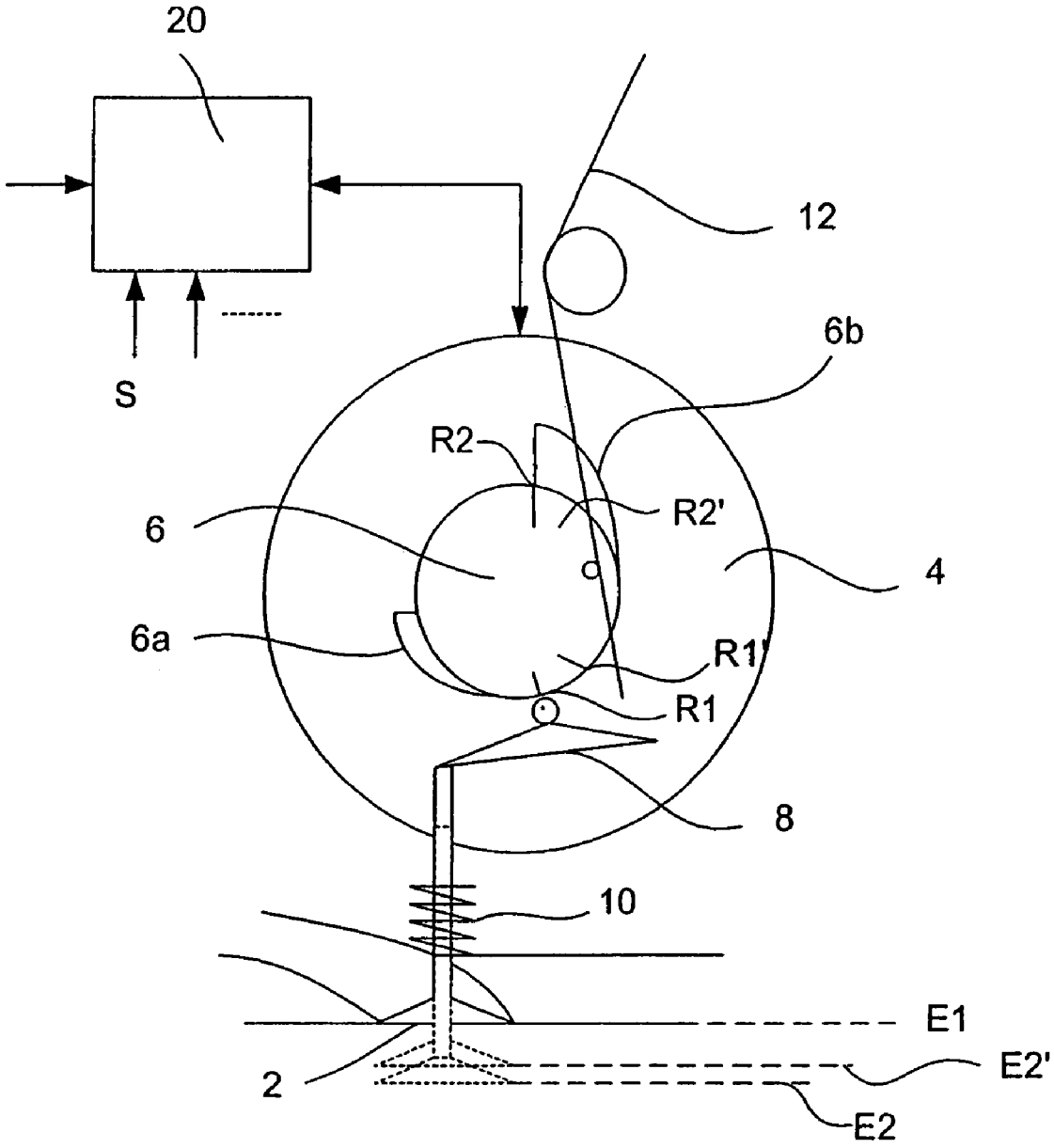
FIG. 1 shows the schematic mechanical design of a rotary actuator device according to the prior art.

FIG. 1 shows a schematic diagram of a rotor actuator device for the drive of a charge cycle valve 2 of an internal combustion engine (not shown). The essential components of this device include an electric motor 4 (drive mechanism), designed as a servo motor in particular, a camshaft 6 (actuating element) having preferably two cams 6*a*, 6*b* of different lifts driven by the electric motor, a rocker lever 8 (transfer element) operatively connected to the camshaft 6 on the one hand and to the charge cycle valve 2 on the other hand, for transmitting the movement of the lift height, which is predetermined by the cams 6*a*, 6*b*, to the charge cycle valve 2 and a first energy storage means 10, which is designed as a closing spring and acts upon the charge cycle valve 2 with a spring force in the closing direction and a second energy storage means 12 that is designed as an opening spring and acts upon the charge cycle valve 2 with an opening force via the camshaft 6 and the rocker lever 8. For the precise mechanism of action and mechanical design of the rotary actuator device, reference is made to German Patent Document DE 102 52 991 A1.

To ensure low-energy operation of the electric motor 4, which drives the charge cycle valve 2 via the camshaft 6, the electric motor 4 is regulated by a regulating device 20 according to a setpoint path SB1, SB2, SB3, mapping the ideal transient characteristics of the spring-mass-spring system, in addition to optimal design of the springs acting in opposition to one another (closing spring 10, opening spring 12) and the ideal positioning of the fulcrums and deflection points in the geometry of the device itself. In particular, this regulation is performed by regulating the rotor path of the electric motor 4 which drives at least one actuator element 6, 6*a*, 6*b*. The ideal rotor characteristic, which also oscillates as a part of the oscillating system, is calculated by analogy with the ideal oscillation characteristic of the system as a whole and forms the setpoint path for regulating the electric motor 4. For monitoring the actual position of the rotor, a displacement sensor (not shown) is also present, transmitting a sensor signal S to the regulating unit 20 or another control unit. The electric motor 4 is controlled by the regulating unit 20 in such a way that the at least one charge cycle valve 2 is transferred from a first valve end position E1, corresponding to the closed valve position, for example, to a second valve end position E2, E2', which here corresponds to a valve position that is partially opened, for example (E2': partial lift) or is maximally opened (E2: full lift) and vice versa. In regulating the electric motor 4, the position of the rotor and thus the position of the actuator element 6, 6*a*, 6*b* operatively connected to the rotor are controlled so that the rotor and/or the actuating element 6, 6*a*, 6*b* will assume a position in the path range of the base circle of the cam, e.g., in the path range between R1 and R1' by analogy with the closed position E1 of the charge cycle valve 2, and will assume a position in the path range of the cam 6*a*, 6*b*, e.g., in the path range between R2 and R2' by analogy with the second end position E2, E2'. This system is ideally designed so that the actuating element 6, 6*a*, 6*b* travels the path between the two end positions R1-R2 or R1'-R2' without input of additional energy, i.e., without being actively driven by the drive unit 4 in the absence of ambient influences (in particular friction and gas backpressure) and thus intervenes in a supportive manner only in the case of ambient influences that occur in practice. The inventive system is preferably designed so that it is in a torque-neutral position at the maximum end positions R1, R2 of the rotor (oscillation end positions at maximum oscillation lift) in which position the resulting forces are in an equilibrium of forces and in which the rotor is held without applying any additionally holding force.

With the calculated ideal transient characteristics, the rotor thus oscillates between one end position E1, E1' and the other end position E2, E2' merely on the basis of the forces stored in the energy storage means 10, 12, without any input of additional energy, e.g., by the electric motor 4. In the case when the rotor oscillates from a first end position R1' to a corresponding second end position R2' in partial lift range the ideal transient characteristics would thus be those of a perpetual motion machine (infinite uniform oscillation). For the case when the rotor is oscillating in full lift range from a first end position R1 to a corresponding second end position R2, it would be held in a torque-neutral position in each of the end positions R1, R2 and would have to execute the next oscillation into the other end position from this held position by introduction of an impulse energy (engine thrust). Due to the fact that the setpoint paths for full lift and for partial lift correspond to the transient characteristics of the rotary actuator device without losses due to friction, this ensures that the regulating unit 20 will control the electric motor 4 exclusively for equalization of the friction losses that always occur in practice. Since friction losses occur mainly at high rotor speeds, the electric motor 4 would have to deliver the greatest power at high speeds. Since this coincides with the energy-optimal operating point of the electric motor 4, an energy-saving operation of the actuator system can be ensured by regulation on the basis of idealized setpoint paths of the actuator system to be operated.

Figure 2:
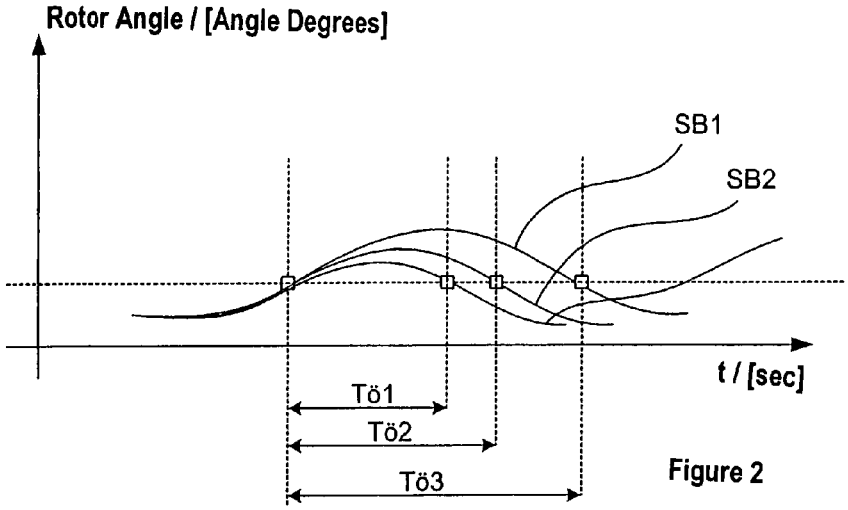
FIG. 2 shows a time chart illustrating setpoint paths of the rotor angle of the drive motor or a rotary actuator over time, mapping the ideal transient characteristic (lift characteristic) of a rotary actuator according to FIG. 1.

FIG. 2 shows a time chart with setpoint paths of the rotor angle of the drive motor of a rotary actuator over time on the basis of which the lift of charge cycle valves is regulated according to this invention. The ideal transient characteristics (lift characteristic) of a rotary actuator device is illustrated by the setpoint paths according to FIG. 1. This shows three different setpoint paths SB1, SB2 and SB3, where the first setpoint path SB1 represents the maximum lift (rotor oscillating back and forth between R1 and R2; valve position is established between E1 and E2) of the charge cycle valve 2 at a predetermined control time with a first valve opening time Tö1. The setpoint paths SB2 and SB3 each describe partial lifts (rotor oscillating back and forth between R1' and R2'; valve position established between E1 and E2') with shortened valve opening times Tö2 and Tö3.

Figure 3:
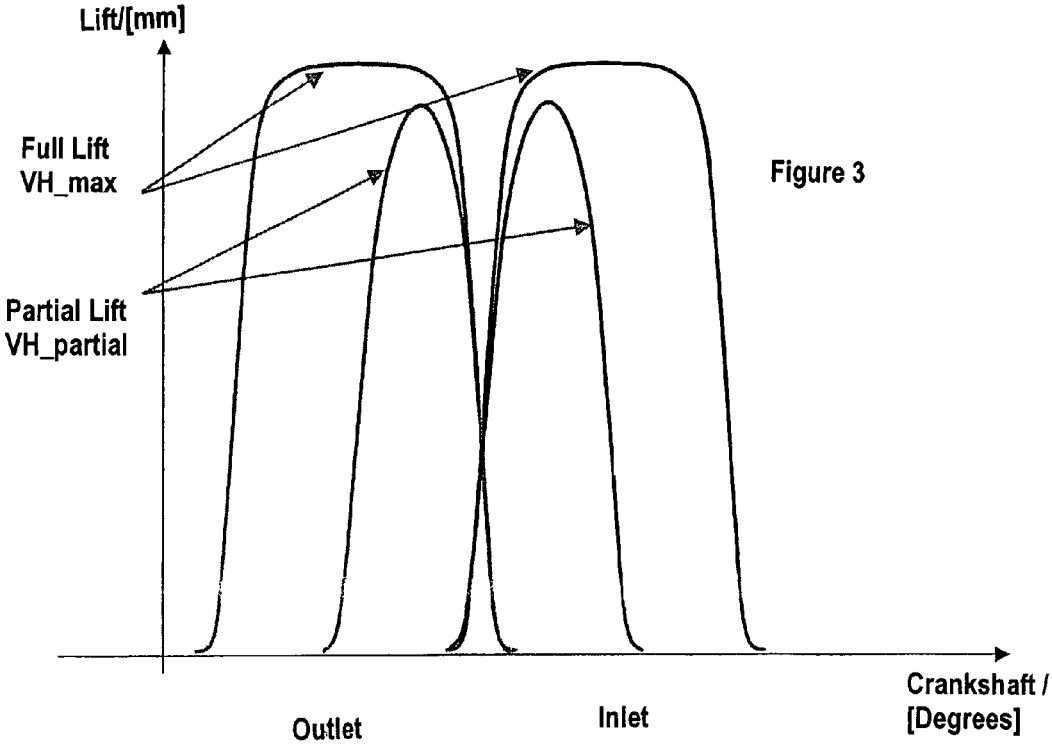
FIG. 3 shows a lift diagram for an intake valve and an exhaust valve of a fully variable valve drive that is regulated on the basis of a regulating device having an ideal setpoint path according to this invention.

FIG. 3 shows the ideal transient characteristic of a charge cycle valve 2 driven by a rotary actuator device according to FIG. 1, where VH_max denotes the maximal valve lift and VH_partial denotes a possible partial lift established on the basis of one of the setpoint paths SB2 or SB3, for example.

What is claimed is:

1. A device for regulating the lift characteristic of a charge cycle valve of an internal combustion engine, comprising:

a controllable drive unit having an actuator element for actuating the charge cycle valve, the drive unit including an electric motor arranged to actuate the charge cycle valve;

two energy storage units acting on the charge cycle valve in opposite drive directions; and a control unit for controlling the drive unit, wherein the control unit comprises a regulating unit which controls the drive unit according to at least one stored setpoint path, on the basis of which the charge cycle valve is transferred between a first end position to a second end position, the at least stored one setpoint path maps an ideal transient characteristic of at least one moving component of an energy storage-drive element-energy storage system of the device.

2. The device as claimed in claim 1, wherein the ideal transient characteristics mapped by each of the stored setpoint paths maps an ideal transient characteristics of a rotor of the electric motor drive unit.

3. The device as claimed in claim 1, wherein a plurality of setpoint paths is stored, at least one of the setpoint paths describes a lift characteristic of the charge cycle valve between the first end position at a valve lift equal to zero and the second end position at a maximum valve lift, and at least one of the remaining plurality of setpoint paths describes a lift characteristic of the charge cycle valve between the first end position and a predetermined intermediate position at a partial valve lift.

4. The device as claimed in claim 3, wherein the regulating unit is programmed to generate at least one additional setpoint path by interpolation between two stored setpoint paths.

5. The device as claimed in claim 1, wherein a transfer element is arranged between the actuating element and the charge cycle valve for actuation of the charge cycle valve.

6. The device as claimed in claim 1, wherein the drive unit is a synchronous machine.

7. The device as claimed in claim 1, wherein the actuator element is a cam arranged on a shaft.

8. The device as claimed in claim 1, wherein one of the two energy storage units is an opening spring that acts with a spring force on the charge cycle valve in a valve opening direction and the other of the two energy storage units is a closing spring that acts with a spring force on the charge cycle valve in a valve closing direction.

9. The device as claimed in claim 8, wherein the energy storage unit acting on the charge cycle valve in the valve opening direction is a spiral rod spring.

10. The method for regulating the lift characteristic of a charge cycle valve of an internal combustion engine having an actuator device, the actuator device comprising a drive unit including an electric motor controllable via a regulating unit and two energy storage means acting in opposite drive directions on a drive element, comprising the steps of:

actuating with the controllable drive means the drive element to transfer the charge cycle lift valve between a first end position and a second end position in response to at least one signal from the regulating unit, wherein the regulating unit controls actuation of the drive element according to at least one stored setpoint path, and the at least one stored setpoint path maps an ideal transient characteristic of at least one moving component of an energy storage-drive element-energy storage system of the device.

* * * * *